US006470957B1

(12) United States Patent
Ashburn

(10) Patent No.: US 6,470,957 B1
(45) Date of Patent: Oct. 29, 2002

(54) PROCESS FOR CASTING A CONTINUOUS METAL STRAND

(75) Inventor: Ronald E. Ashburn, Coraopolis, PA (US)

(73) Assignee: Mannesmann AG, Düsseldorf (DE)

( * ) Notice: Subject to any disclaimer, the term of this patent is extended or adjusted under 35 U.S.C. 154(b) by 0 days.

(21) Appl. No.: 09/357,296

(22) Filed: Jul. 16, 1999

(51) Int. Cl.[7] ..... B22D 11/20

(52) U.S. Cl. ..... 164/454; 164/455; 164/154.6; 164/154.8

(58) Field of Search ..... 164/454, 442, 164/413, 414, 455, 150.1, 151.4, 154.6, 448, 154.8

(56) References Cited

U.S. PATENT DOCUMENTS 5,649,889 A * 7/1997 Warner, III ..... 164/448
5,850,871 A * 12/1998 Sears, Jr. ..... 164/454
6,062,295 A * 5/2000 Greiwe ..... 164/442
6,199,621 B1 * 3/2001 Weyer et al. ..... 164/442

* cited by examiner

*Primary Examiner*—Tom Dunn
*Assistant Examiner*—I.-H. Lin
(74) *Attorney, Agent, or Firm*—Cohen, Pontani, Lieberman & Pavane

(57) ABSTRACT

A process for casting a continuous metal strand, in particular steel, in a continuous casting apparatus having strand parts disposed opposite one another and being fitted with bearings in which guide rollers are mounted, and having actuators by which a gap between respective opposed rollers can be set infinitely variable, and which method includes sensing a value representing a compressive force which occurs in the bearings and feeding said value to a computing unit; comparing the individual measured force values of a roller or of a pair of oppositely disposed rollers with respect to a level of the force; and utilizing at least the relating highest value measured as a command variable for controlling the gap and/or the casting rate and/or the amount of cooling water and/or the melt feed and/or the casting powder feed and/or the mold oscillation.

7 Claims, 2 Drawing Sheets

PROCESS FOR CASTING A CONTINUOUS METAL STRAND

BACKGROUND OF THE INVENTION

1. Field of the Invention

The present invention relates to a process and apparatus for casting a continuous metal strand, in particular of steel, in a continuous casting apparatus having stand parts disposed opposite one another and fitted with bearings in which guide rollers are mounted, and having actuators by which the gap between respective appropriately disposed rollers can be set infinitely variably.

2. Description of the Related Art

During the continuous casting, for example, of rectangular formats, the gap, i.e. the clear spacing, between two rollers lying opposite one another is set to correspond to the shrinkage behavior of the strand formed into the slab or bloom over the length of the machine. In so-called soft reduction, the gap is set narrower as the shrinkage behavior of the strand proceeds, in order to achieve an improvement in the internal quality, in particular of the slab, in the area of residual solidification. Since the position of the lowest point of the liquid pool in which the residual solidification takes place can change during operation, an adaptation of the clear roller spacing during the casting process is desired.

U.S. Pat. No. 4,131,154 (EP 0 618 024) discloses a strand guiding assembly in a continuous casting apparatus for the production of slabs, in particular by the continuous casting and rolling process, having rollers lying opposite one another in pairs and which can be set to different strand thicknesses. The rollers are mounted in frame or stand parts of the strand guiding assembly which are connected by tie rods and spacers are placed in the flux of force between upper and lower frame parts. Provided on the frame parts is an annular piston, which bears the spacer by non-positive action and the adjusting path of the annular piston is dimensioned in such a way that, in the pressure-relieved state, said annular piston fixes the stand parts at a spacing between the rollers which corresponds to the desired strand thickness. The strand guiding assembly is consequently able to set the guide rollers in three defined positions, in particular during the continuous casting and rolling of thin slabs in the partially solidified area.

EP 0 545 104 discloses a process and an apparatus for the continuous casting of slabs or blocks in a continuous casting apparatus with a soft-reduction zone which has rollers which can be adjusted against one another individually or as a segment by means of hydraulic cylinders. The rollers can be set infinitely variably with a clear spacing with respect to one another by means of spindles, the spindles being moved with reduced load to a desired gap value.

While in the first-mentioned reference consideration is given exclusively to the displacement, that is the spacing of the stand parts, and consequently indirectly to the clear spacing of the rollers, in the second reference the force required for compressing the strand is already a consideration. In an exemplary embodiment, the tie rods designed as spindles are supported on pressure cells. In a further example, the hydraulic pressure of the adjusting cylinders is sensed. In both embodiments, however, the force is exclusively sensed only indirectly, a mathematical model often also being used as a basis for reproducing the conditions in the strand shell.

In the force flux system which involves the roller over its entire length, the bearings in which the rollers are guided, the stand parts on which the bearings are supported and the tie rods which are moved mechanically or hydraulically, there are a series of possibilities for errors which have an influence on the force exerted on the strand and consequently on its quality.

SUMMARY OF THE INVENTION

It is therefore an object of the present invention to provide a process and a corresponding apparatus with which the actual force and position conditions at the contact surface between roller and strand can be sensed for the production of slabs, blocks or round sections of the highest quality and dimensional accuracy.

The invention achieves this object by a process for casting a continuous metal strand, in particular steel, in a continuous casting apparatus having stand parts disposed opposite one another and being fitted with bearings in which guide rollers are mounted, and having actuators by which a gap between respective rollers oppositely disposed can be set infinitely variably and which method comprises sensing a value representing a compressive force which occurs in the bearings and feeding said value to a computing unit; comparing the individual measured force values of a roller or of a pair of oppositely disposed rollers with respect to a level of the force; and utilizing at least the relatively highest value measured as a command variable for controlling one of the gap, the casting rate, the amount of cooling water, the melt feed, the casting powder feed and the mold oscillation.

The continuous casting apparatus of the present invention is an apparatus for casting continuous metal strands, in particular from steel such as slabs, blooms and round sections, and comprising stand parts disposed opposite one another and fitted with bearings in which guide rollers are rotatably mounted and actuators which are connected to tie-rods for the infinitely variable setting of the gap between respective oppositely disposed rollers, and further comprising a computing unit which is connected in measuring and controlling terms to measuring and controlling elements and wherein measuring elements for sensing the compression force are provided in the bearings.

According to the present invention, the compressive force occurring in the bearings provided for the mounting of the rollers is sensed and fed to a computing unit. In slab continuous casting installations, split rollers are often used, so that there is at least one central bearing.

The measured values sensed in the bearings are compared with respect to their level and processed in the computing unit. In this case, at least the highest value is used as a command variable for controlling the following measures essential for the continuous casting process:

- for the adapted setting of the gap, i.e. for the desired clear spacing of the rollers as a function of their position in the strand guiding stand and the current position of the lowest point of the liquid pool,
- for regulating the casting rate,
- for influencing the amount of cooling water for the cooling of the rollers or the bearings and/or the amount of spray cooling water,
- for setting the melt feed by taking into consideration the melt height in the tundish and, in particular, by setting the outflow rate from the storage vessel or the ladle,
- for setting the casting powder feed, and/or
- for adjusting the mold oscillation.

In order not to allow the entire system to become unstable, essentially one value is selected as the main controlled variable from the influencing possibilities stated.

In a preferred embodiment, the actual temperature in the bearings is sensed in addition to the compressive force.

As further setpoint selections, the melt temperature, the continuous casting format, the melt quality and the strand shell thickness, determined by automatic selection, are made available to the computer. The fast and exact sensing of the conditions in the area close to the slab/roller system allows the values recorded in the bearings to be passed directly and at high speed to the computing unit. In a preferred embodiment, these measured values are fed to the computing unit as a function of time and/or position, and are processed very much on the basis of the current situation for controlling the individual actuators.

The large volume of data can be set as desired. In order to stem the flood of data and nevertheless acquire a virtually complete picture of the current situation, it is provided in a further preferred embodiment to feed the measured values to the computer in a cycled manner as a function of the rotation of the individual rollers. It is particularly preferred to pass the measured values to be passed on every 9 to 12 angular degrees of the rotating roller.

Independently of the measured values for the force and/or temperature, the flexure or bending of the individual stands, in particular of the lower or upper yoke, may be sensed and taken into consideration in the determination of the effective compressive force in the bearings. In a further embodiment, at least two force elements are installed for each bearing. In this way it is possible to sense the exact position of the force vector prevailing there.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

BRIEF DESCRIPTION OF THE DRAWINGS

An example of the present invention is shown in the accompanying drawing, in which.

DETAILED DESCRIPTION OF THE PRESENTLY PREFERRED EMBODIMENTS

Figure 1:
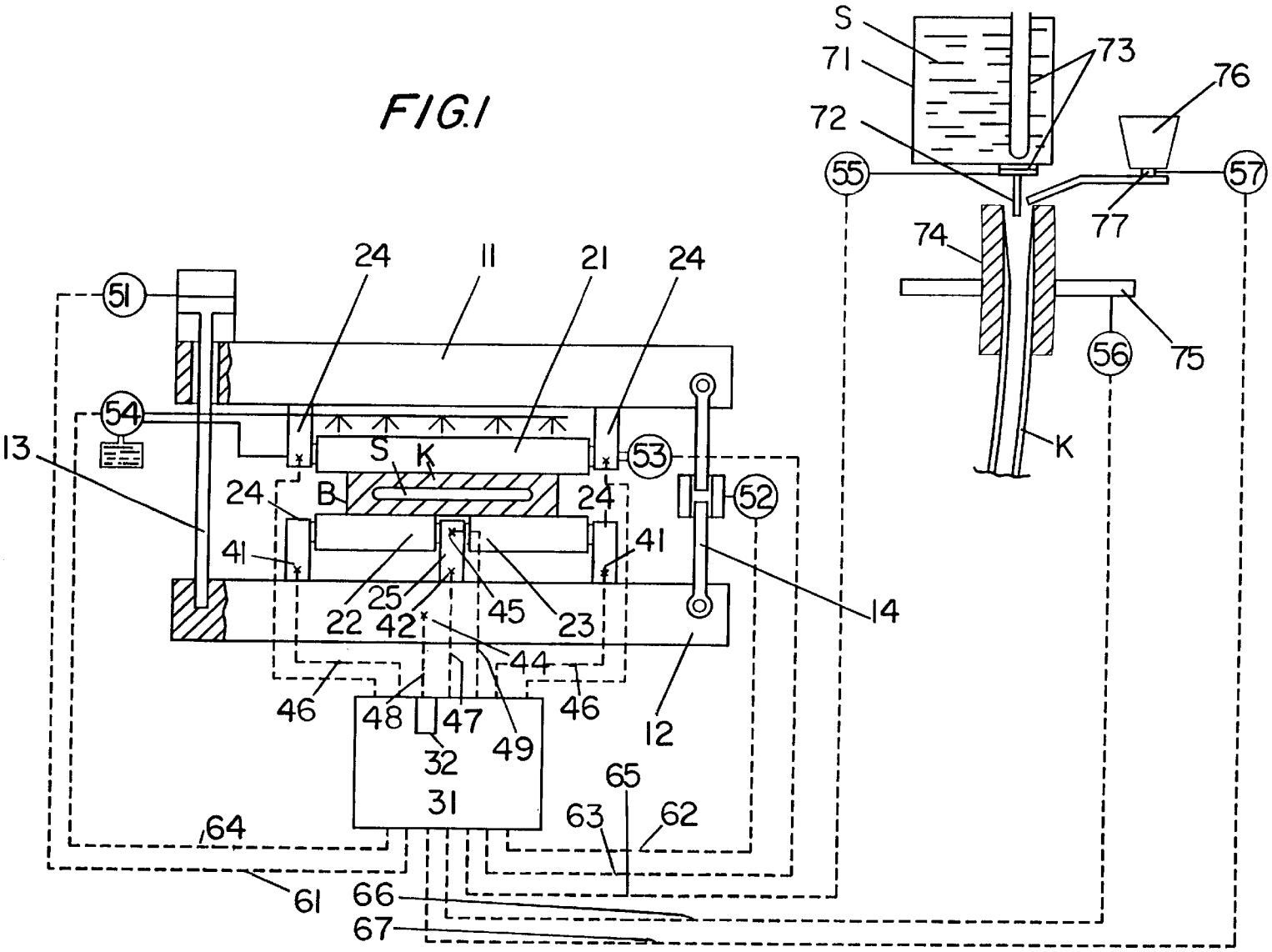
FIG. 1 is a plan view of a stand.

FIG. 1 shows an upper stand 11, which is connected by means of tie rods 13, 14 to a lower stand part 12. In the left-hand part of the figure, the tie rod 13 is hydraulically actuated and thus connected to an actuator 51. In the right-hand part of FIG. 1, the tie rod 14 can be mechanically actuated and is connected to an actuator 52.

The upper stand part is connected to a one-part roller 21, which is mounted in outer bearings 24.

The lower stand part has a so-called split roller, having a first split roller 22 and a second split roller 23. The rollers 22, 23 are mounted in outer bearings 24 and in a central bearing 25.

Between the rollers 21 and 22, 23 there is a slab B, which has a shell casing K, which encloses the melt S.

Provided in the outer bearings 24 and in the central bearing 25 are compressive force-measuring elements 41 and 42, respectively, which are connected to a computing unit 31 via measuring lines 46 and 47.

Additionally provided in the central bearing 25 is a temperature-measuring element 45, which is connected to the computing unit 31 via a measuring line 49. Also arranged in the lower stand 12 is a measuring element 44, here formed as a displacement measuring element, which is connected to the computing unit 31 via a measuring line 48.

The computing unit is connected via control lines 61 to 67 for setting the following actuators:

51 and 52 for the gap,

53 for the roller speed,

54 for the amount of cooling water,

55 for the melt shut-off element,

56 for the oscillation, and/or

57 for the casting powder shut-off element.

Shown diagrammatically in the right-hand upper part is a storage vessel 71, at the bottom of which there is arranged an immersion nozzle 72, by means of which the melt S is directed in a controllable manner via a shut-off element 73 to a permanent mold 74. The permanent mold 74 is made to vibrate by means of a mold oscillation device 75.

The upper, open part of the permanent mold 74 is connected to a casting powder vessel 76, on which a shut-off element 77 and actuator 57 are provided.

Figure 2:
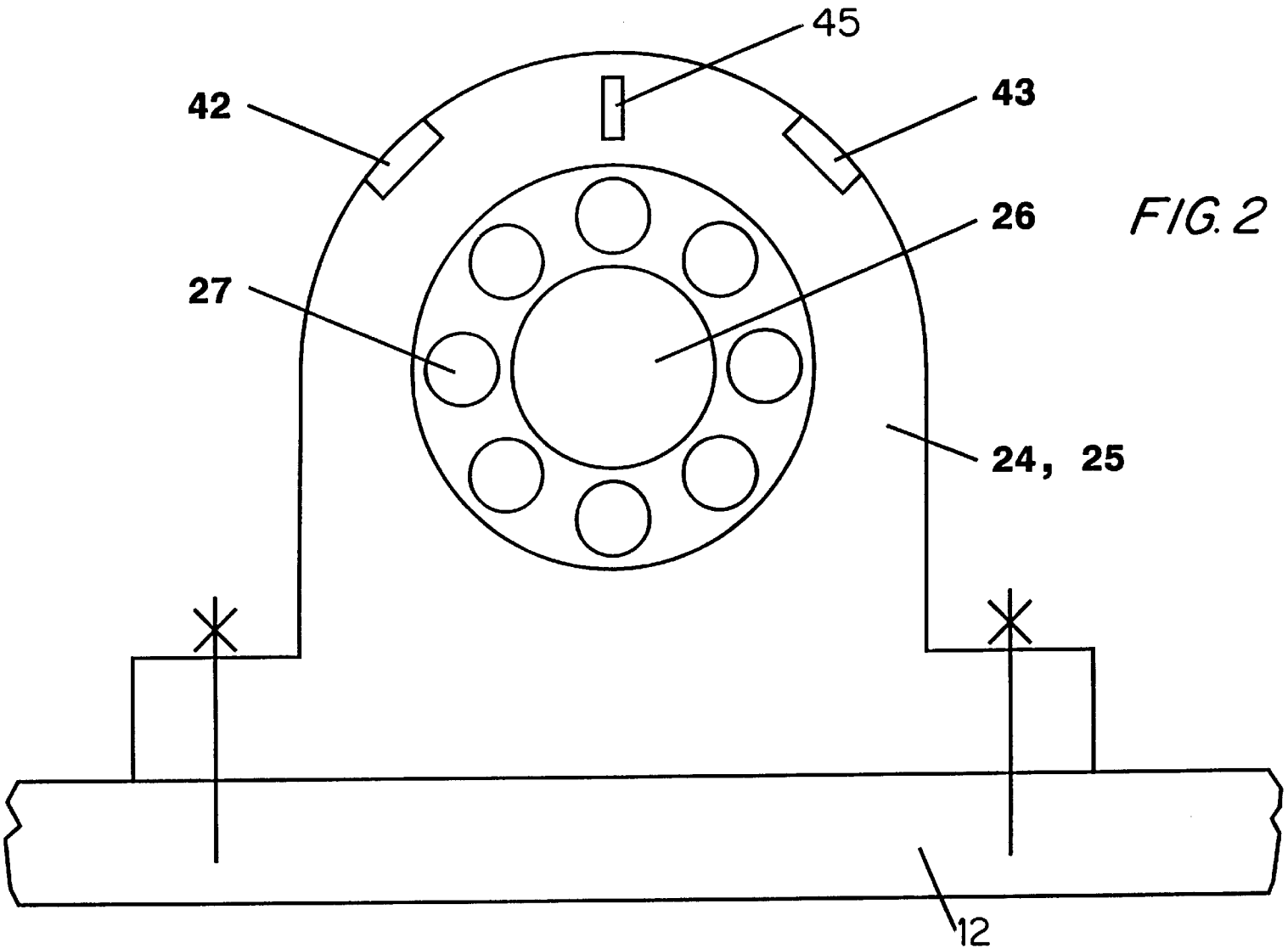
FIG. 2 is a plan view of a bearing.

FIG. 2 shows the lower stand part 12, on which the bearing 24 or 25 is fastened.

The roller 21–23, not shown in further detail, is mounted by means of a roller pin 26 in anti-friction bearing rollers 27.

Arranged in the housing of the bearing 24 or 25, distributed around the circumference, are at least two compressive force-measuring elements 42, 43. These force-measuring elements are suitably formed as a measuring strip. In the present case, the installation is set to 2 o'clock or 10 o'clock. In this way, the exact position of the force vector can be sensed.

In addition, a temperature element 45 is fitted in the bearing housing 24 or 25, at a distance from the outer edge. The temperature sensing element at the bearings permits the monitoring of the bearing life as part of a preventive maintenance program. An increase in bearing temperature can signify an increased friction level, possibly caused by insufficient lubrication and/or insufficient supply of cooling water and/or overloading of the rated bearing capacity, which can lead to premature bearing failure. These bearing failures occur frequently but are very difficult to predict or to monitor prior to a noticeable reduction in the quality of the cast strand. The described bearing protection technology can, of course, be applied to existing casting apparatus which do not have the ability for the infinitely variable setting of the gap between opposed rollers during casting as described above.

The invention is not limited by the embodiments described above which are presented as examples only but can be modified in various ways within the scope of protection defined by the appended patent claims.

I claim:

1. A process for casting a continuous metal strand in a continuous casting installation having stand parts lying opposite one another and fitted with bearings in which respectively opposed guide rollers are mounted, and having actuators by which a gap between the respectively opposed rollers can be set infinitely variably, said process comprising the following steps:

a) sensing a value of a compressive force occurring in the bearings and feeding said value to a computing unit;

b) comparing individual measured values of a roller or of a pair of oppositely arranged rollers with respect to a level of said compression force; and c) utilizing at least a relatively highest value measured as a command variable for controlling at least one of the gap, a casting rate, an amount of cooling water, a melt feed, a casting powder feed, and a mold oscillation.

2. The process as claimed in claim 1, additionally comprising the step of sensing a temperature value prevailing in the bearings as a temperature value in addition to the compressive force and feeding a temperature representing value to the computing unit.

3. The process as claimed in claim 1, additionally comprising the step of comparing the sensed current actual compressive force and temperature values in the computing unit with setpoint values, said setpoint values being selected as a function of position of the respective roller in the stand, concerning at least one of the casting rate, melt temperature, strand format, strand shell thickness, and melt quality.

4. The process as claimed in claim 1, wherein a trend of the measured values as a function of one of time and roller position is received and processed by the computing unit for said controlling step.

5. The process as claimed in claim 1, wherein in step a) the measured values are fed to the computing unit cyclically as a function of rotation of the individual rollers.

6. The process as claimed in claim 5, wherein the measured values are fed to the computing unit every 9 to 12 angular degrees of rotation of the roller.

7. The process as claimed in claim 5, additionally comprising sensing a value reflecting bending of the individual stands and taking said bending value into consideration in the determination of an effective compressive force in the bearings.

* * * * *